United States Patent [19]

Carmody

[11] 4,427,071

[45] Jan. 24, 1984

[54] FLAPPER TYPE SAFETY VALVE FOR SUBTERRANEAN WELLS

[75] Inventor: Michael A. Carmody, Broken Arrow, Okla.

[73] Assignee: Baker Oil Tools, Inc., Orange, Calif.

[21] Appl. No.: 349,785

[22] Filed: Feb. 18, 1982

[51] Int. Cl.[3] ..... E21B 34/10; E21B 34/12

[52] U.S. Cl. ..... 166/332; 166/325

[58] Field of Search ..... 166/320–325, 166/332, 334; 251/298, 349, 354

[56] References Cited

U.S. PATENT DOCUMENTS

| | | | |
|---|---|---|---|
| 2,162,578 | 6/1939 | Hacker | 166/325 X |
| 3,021,151 | 1/1963 | Sizer | 166/324 X |
| 3,845,818 | 11/1974 | Deaton | 166/324 X |

*Primary Examiner*—Stephen J. Novosad
*Assistant Examiner*—Joseph Falk
*Attorney, Agent, or Firm*—Norvell & Associates

[57] ABSTRACT

The disclosure relates to an improved flapper type safety valve for use in subterranean wells wherein the flapper valve is actuated from a horizontal closed position to a vertical open position by contact from a downwardly moving actuating sleeve. The top surface of the valve is elevated so that the bottom edge of the actuating sleeve always contacts the flapper valve at a position maximally spaced from the axis of its pivot mounting, thereby assuring that the opening force applied to the flapper valve has a maximum moment arm in order to overcome any fluid pressure differential existing across the flapper valve.

1 Claim, 3 Drawing Figures

FLAPPER TYPE SAFETY VALVE FOR SUBTERRANEAN WELLS

BACKGROUND OF THE INVENTION

1. Field of the Invention:

The invention relates to a safety valve for a subterranean well of the type employing a pivotally movable flapper which cooperates with an annular valve seat defined on a well conduit.

2. Description of the Prior Art:

Flapper type safety valves have long been employed in subterranean wells. One of the common forms of actuating mechanisms for such flapper valve is an actuating sleeve having a piston shoulder formed thereon upon which fluid pressure is imposed to drive the sleeve downwardly and thus pivot the flapper valve from a transverse, closed position to a vertical, open position. Due to the accumulation of tolerances involved in the assemblage of the flapper valve and the actuating sleeve to the well conduit, it often happens that the actuating sleeve engages the upper surface of the flapper valve at a point that is closely proximate to the pivot mounting axis of the flapper valve. In many cases, the well pressure below the flapper valve is in excess of the fluid pressure existing above the valve so a substantial fluid pressure differential exists across the flapper valve opposing its movement. If the actuating sleeve only contacts the flapper valve at a region close to its pivotal axis, it is obvious that a substantially greater force must be applied by the sleeve to the flapper valve to effect its opening.

In addition to the high opening forces which can be created by a pressure differential from below a flapper valve, problems can also arise as the flapper valve closes under large pressure differentials. Damage can result when the flapper valve, moving rapidly under the influence of large pressure differentials, strikes the stationary valve seat. Damage to the flapper valve and to the valve seat can seriously affect the integrity of a flapper type safety valve.

In prior art flapper valves, protrusions extending from the outer edges of the upper surface have been used to establish initial contact between the flapper valve and a flow actuating tube at a location spaced from the hinge or pivot of the valve. These spaced protrusions have served to increase the moment acting on the flapper valve in opposition to pressure differentials below the valve. These protrusions can, however, create space problems when the valve is open and the actuating sleeve extends past the protrusions and can reduce the flow area available through the valve when a flapper valve having a flat upper surface is used.

One means of solving this space problem is disclosed in U.S. Pat. application Ser. No. 280,039 filed July 6, 1981. This flapper valve configuration has a configuration identical to a section cut through a tubular member about an axis normal to the axis of the tubular member. The flapper valve disclosed and claimed herein combines a structure adapted to overcome the problems arising from large pressure differentials existing below the valve and the dimensional constraints required for a valve with the largest possible flow area.

SUMMARY OF THE INVENTION

In accordance with this invention, a flapper valve is pivotally mounted to one side of a tubular conduit and is provided with an annular sealing surface that cooperates with a downwardly facing, conical segment sealing surface formed on the well conduit. An actuating sleeve is vertically reciprocable in the tubular conduit and downward movement of the sleeve will effect its engagement with the upper surface of the flapper valve to apply downward opening force to the flapper valve. In accordance with this invention, the upper surface of the flapper valve comprises a planar surface elevated at an angle of at least 5° relative to the radial plane of the actuating sleeve, with the direction of the elevation being upward and away from the pivot axis of the flapper valve. Such elevated upper surface of the flapper valve insures that the actuating sleeve will contact the flapper valve at a position remote from the pivotal axis of the flapper valve. Additionally, the elevated surface of the flapper is provided with a cylindrical segment recess of substantially the same diameter as the exterior diameter of the actuating sleeve and disposed relative to the pivotal axis of the flapper so as to snugly conform to the actuating sleeve when the flapper valve is shifted to its fully open, vertical position. The recess minimizes the interference between the flapper valve and the actuating sleeve in the open position and increases the available flow area.

Further objects and advantages of the invention will be readily apparent to those skilled in the art from the following detailed description, taken in conjunction with the annexed sheet of drawings on which is shown a preferred example of the invention.

DESCRIPTION OF THE PREFERRED EMBODIMENT

Figure 1:
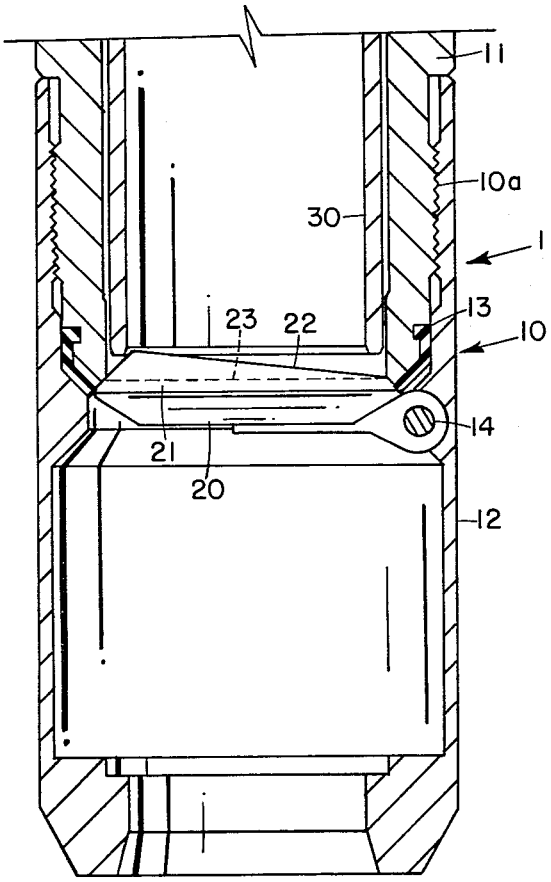
FIG. 1 is a vertical sectional view of a flapper valve assembly incorporating this invention, with the flapper valve being shown in its horizontal, closed position.

Referring to the drawings, there is shown a portion of a safety valve 1 incorporating a flapper actuating mechanism embodying this invention. Safety valve 1 includes a tubular conduit or housing 10 formed by the threaded assemblage 10*a* of an upper housing element 11 and a lower sleeve like housing element 12. Upper housing element 11 provides a mounting at its bottom end for a downwardly facing, annular elastomeric seal 13. A conical annular valve seat 32 is defined on the lower innermost surface of upper housing element 11. Annular elastomeric seal 13 encircles the annular valve seat at its lower end.

A flapper valve 20 is provided defining on its upper surface an outer annular conical sealing surface 21 which is configured to sealingly engage conical valve seat 32 and annular elastomeric seal 13 when disposed in its horizontal closed position illustrated in FIG. 1. The flapper 20 is further provided with integral hinge portions 24 which receive a pivot pin 14 to effect the pivotal mounting of the flapper 20 on the lower housing element 12 of the conduit 10. A torsion spring (not shown) is provided which is conventionally wrapped around the pin 14 to exert an upward pivotal bias on the flapper 20 urging it to its closed, sealed position.

As is well-known to those skilled in the art, the flapper 20 is moved to its open position through the downward movement of an actuating sleeve 30 which is slidably disposed within the interior bore of the upper housing 11. The actuating sleeve 30 is provided on its upper portions with a piston shoulder (not shown) which cooperates with a fluid pressure chamber defined between the actuating sleeve 30 and the interior bore of the conduit 10. This construction is conventional and is, for example, disclosed and illustrated in the co-pending application Ser. No. 232,473, filed Feb. 9, 1981, which is assigned to the same Assignee as the instant application. It is obvious from the drawings that forcible downward movement of the actuating sleeve 30 will overcome the bias of the torsion spring operating on the flapper 20 and any fluid pressure differential and force the flapper 20 downwardly to a substantially vertical open position illustrated in FIG. 2.

In order to insure that the bottom edge of actuating sleeve 30 always contacts the flapper 20 at a position maximally spaced from the axis of the pivot pin 14, the flapper valve 20 is provided with an elevated top surface 22 which in this embodiment comprises a planar surface sloping upwardly and away from the axis of pivot mounting pin 14 at an angle of approximately 5°. With this configuration, the bottom edge portions of the actuating sleeve 30 will provide the first contacts with the flapper 20 at a position providing essentially the maximum possible moment arm about the axis of the pivot pin 14. The actuating sleeve will initially strike the annular conical sealing surface 21. Because of the elevation of surface 22, the initial points of contact will lie above the cooperable sealing surface of the valve seat and will be spaced from the hinge. Thus, the flapper valve 20 may be opened even though a substantial fluid pressure differential exists across the valve, without incurring the risk of damaging the flapper 20, its pivot mounting pin 14, or the actuating sleeve 30. When the flapper valve closes in the presence of a substantial fluid pressure differential, which can result in rapid closure of the flapper because of the large forces acting on it, the flapper will initially strike the actuating sleeve 30 rather than the valve seat 32. The actuating sleeve which is urged downward by fluid pressure will serve to damp the movement of the flapper as the flapper valve 20 exerts a force in the upward direction. During a substantial portion of the rotation of the flapper valve, it will exert a three point upward loading on the actuating sleeve. During closure, the tubing will engage the conical sealing surface 21 at a point adjacent the hinge 24 and will engage the conical sealing surface 21 on opposite sides of recess 23 at the elevated outer edges of the flapper.

Figure 2:
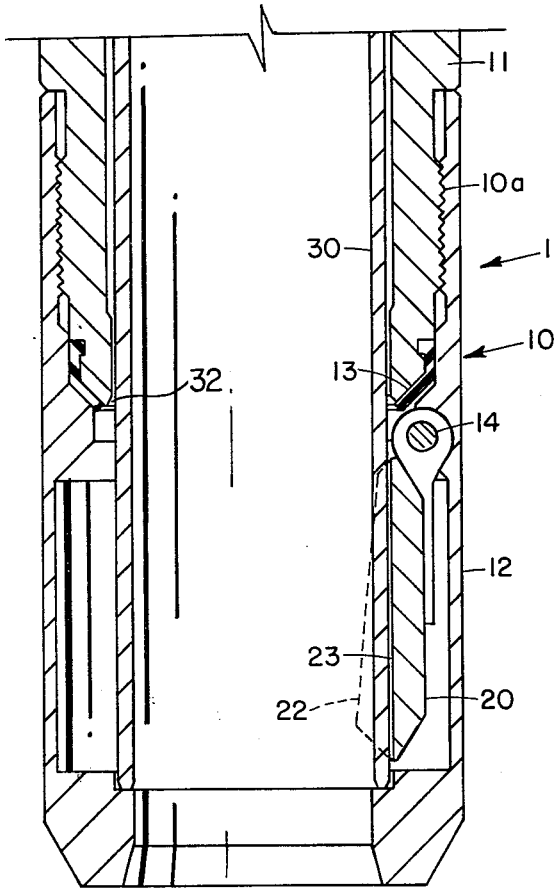
FIG. 2 is a view similar to FIG. 1 but with the flapper valve shown in its vertical, fully opened position.
Figure 3:
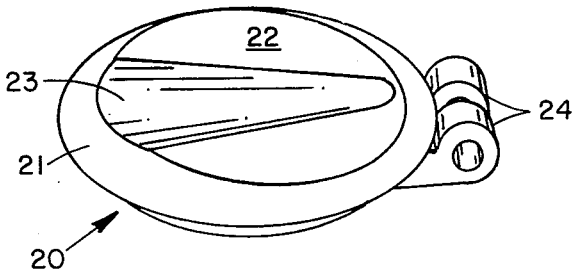
FIG. 3 is a perspective view of the flapper valve utilized in the assemblage of FIG. 1.

The elevated surface 22 is further provided with an arcuate, cylindrical segment recess 23. Recess 23 has a curvature corresponding to the external diameter of the actuating sleeve 30 so that it snugly conforms to the actuating sleeve 30 when the flapper 20 lies in its fully open, vertical position, as illustrated in FIG. 2. Recess 23 permits complete opening of the flapper 20 without reducing the flow area through actuating sleeve 30 and through the valve itself or without unduly increasing the size or reducing the thickness of lower housing element 12. Recess 23 not only extends through the elevated upper surface 22 but also extends through the conical sealing surface 21 adjacent the exterior of the flapper. The intersection of the sealing surface 21 with inclined elevated surface 22 on opposite sides of recess 23 thus defines the two uppermost extensions of the flapper valve 20. It is at these two points, spaced from hinge 24 and from the axis of the valve where resultant pressure forces will act, that the actuating sleeve will initially contact to open flapper valve 20. Adequate sealing area will still exist on surface 21 below recess 23 to fully contact annular conical valve seat 32 when the valve is closed.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A flapper type valve for a subterranean well comprising, in combination: a tubular conduit, means on said tubular conduit defining a downwardly facing, annular conical valve seat; a flapper valve having an annular conical surface cooperable with said valve seat in sealing relation; pivot means on one side of said tubular conduit for mounting said flapper valve to said conduit to permit downward pivotal movement of said flapper valve away from said valve seat to a vertical open position; resilient means urging said flapper valve upwardly to its closed sealing position; a valve actuating sleeve disposed in said tubular conduit, means for moving said actuating sleeve downwardly to engage and open said flapper valve; an elevated top surface on said flapper valve said elevated surface on said flapper valve comprising a planar surface inclined relative to a radial plane of said actuating sleeve, said planar surface being sloped upwardly away from said pivotal means; said annular conical surface cooperable with said valve seat extending upwardly beyond said valve seat to receive the initial contact of said actuating sleeve remote from said pivot means; and an arcuate cylindrical recess of the same diameter as the exterior of said actuating sleeve, extending through said elevated surface and said annular conical surface, and being positioned to receive the exterior of said actuating sleeve when said flapper valve is shifted downwardly by said sleeve to its vertical open position.

* * * * *